US010153553B2

(12) United States Patent
Kawaguchi et al.

(10) Patent No.: US 10,153,553 B2
(45) Date of Patent: Dec. 11, 2018

(54) ANTENNA DEVICE HAVING PATCH ANTENNA

(71) Applicant: DENSO CORPORATION, Kariya, Aichi-pref. (JP)

(72) Inventors: Kazushi Kawaguchi, Nishio (JP); Asahi Kondo, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 15/103,266

(22) PCT Filed: Dec. 8, 2014

(86) PCT No.: PCT/JP2014/082443
§ 371 (c)(1),
(2) Date: Jun. 9, 2016

(87) PCT Pub. No.: WO2015/087840
PCT Pub. Date: Jun. 18, 2015

(65) Prior Publication Data

US 2016/0359232 A1 Dec. 8, 2016

(30) Foreign Application Priority Data

Dec. 11, 2013 (JP) ..... 2013-256083

(51) Int. Cl.
*H01Q 9/04* (2006.01)
*H01Q 1/52* (2006.01)
(Continued)

(52) U.S. Cl.
CPC ..... *H01Q 9/0407* (2013.01); *H01Q 1/48* (2013.01); *H01Q 1/52* (2013.01); *H01Q 15/008* (2013.01)

(58) Field of Classification Search
CPC ..... H01Q 9/0407; H01Q 15/008; H01Q 1/38; H01Q 21/065
(Continued)

(56) References Cited

U.S. PATENT DOCUMENTS 6,262,495 B1 7/2001 Yablonovitch et al.
7,079,079 B2 * 7/2006 Jo ..... H01Q 1/243 343/700 MS (Continued)

FOREIGN PATENT DOCUMENTS

JP 2003-304113 A 10/2003

*Primary Examiner* — Dameon E Levi
*Assistant Examiner* — Hasan Islam
(74) *Attorney, Agent, or Firm* — Knobbe, Martens, Olson & Bear, LLP

(57) ABSTRACT

An antenna device includes: a dielectric substrate formed with a ground plane; a patch antenna having a dominant polarization direction in a predetermined direction on the dielectric substrate; at least one patch radiating element for supplying electric power provided on the patch antenna, the at least one patch radiating element being formed on the dielectric substrate; a patch-shaped conductor pattern formed on a substrate front face of the dielectric substrate on which the patch radiating element is formed; a plurality of connection conductors formed to penetrate the dielectric substrate for electrically connecting the conductor pattern to the ground plane; and a conductive structure having the conductor pattern and a plurality of the connection conductors. A plurality of the conductive structures is provided.

10 Claims, 9 Drawing Sheets

(51) Int. Cl.
*H01Q 15/00* (2006.01)
*H01Q 1/48* (2006.01)

(58) Field of Classification Search
USPC ..... 343/909, 700 MS
See application file for complete search history.

(56) References Cited

U.S. PATENT DOCUMENTS 7,952,526 B2 * 5/2011 Lee ..... H01Q 1/38
343/700 MS
8,786,509 B2 * 7/2014 Johnson ..... H01Q 21/20
343/700 MS
2012/0038526 A1 * 2/2012 Lim ..... H01Q 1/3275
343/713

* cited by examiner

1/9

A-A CROSS SECTION

B-B CROSS SECTION

C-C CROSS SECTION

FIG.4A COMPARATIVE STRUCTURE (ONE CONDUCTING VIA)
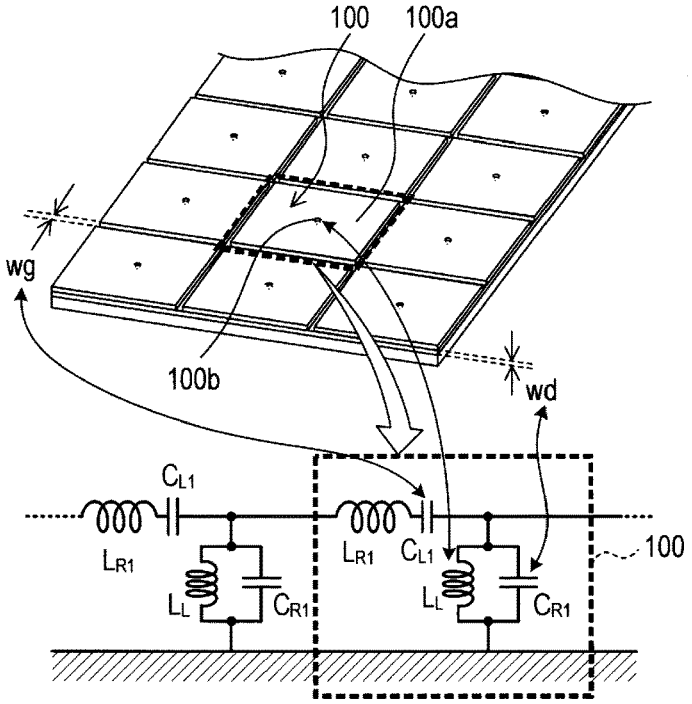
FIG.4B STRUCTURE OF FIRST EMBODIMENT (FOUR CONDUCTING VIAS)
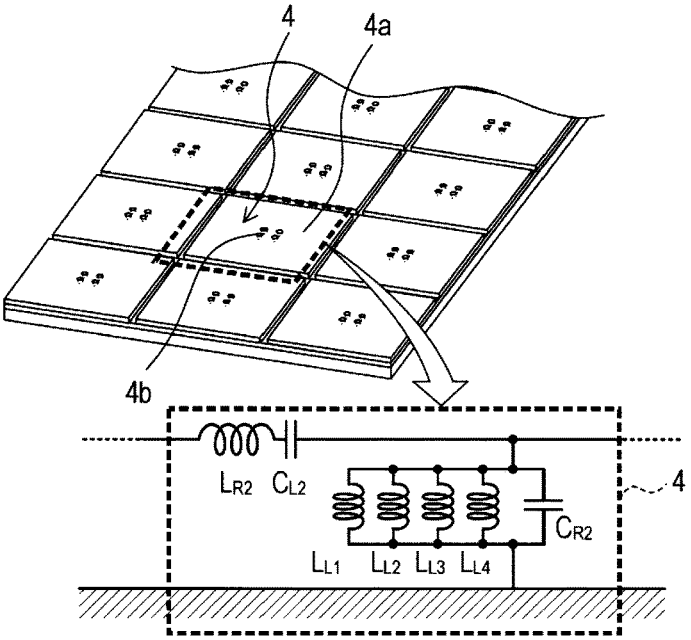

COMPARATIVE STRUCTURE (ONE CONDUCTING VIA)
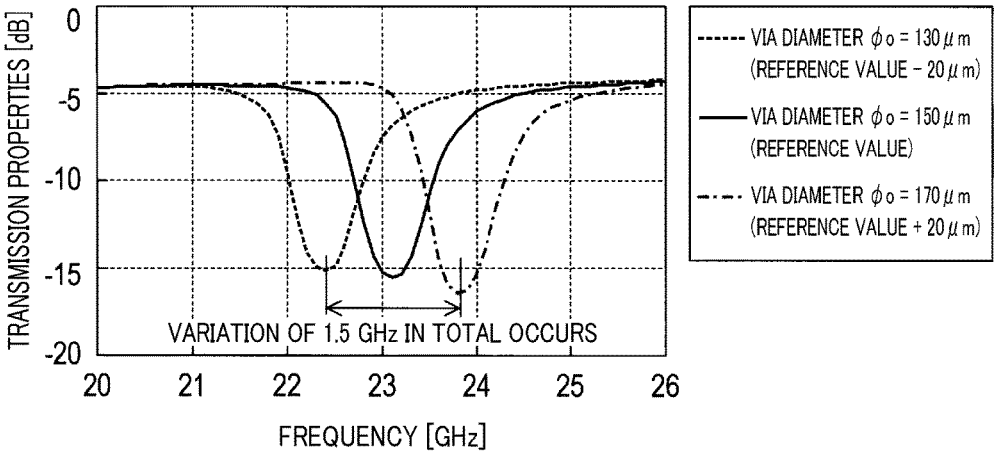
FIG.5B
STRUCTURE OF FIRST EMBODIMENT (FOUR CONDUCTING VIAS)
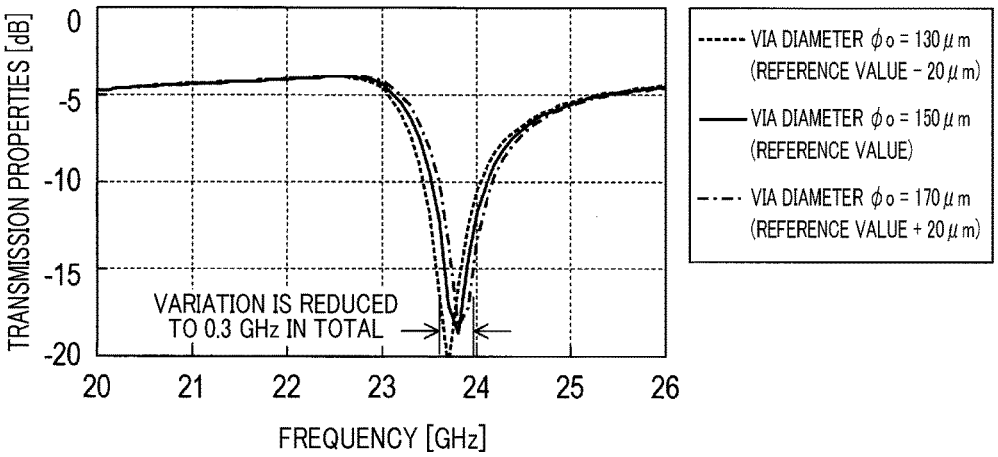

COMPARATIVE EXAMPLE 1 WITH NO EBGS

COMPARATIVE EXAMPLE 2 WITH EBGS (ONE CONDUCTING VIA)

ANTENNA DEVICE 1 OF FIRST EMBODIMENT WITH EBGS (FOUR CONDUCTING VIAS)

ANTENNA DEVICE HAVING PATCH ANTENNA

CROSS-REFERENCE TO RELATED APPLICATION

This application is based on and claims the benefit of priority from earlier Japanese Patent Application No. 2013-256083 filed Dec. 11, 2013, the description of which is incorporated herein by reference.

BACKGROUND OF THE INVENTION

Technical Field

The present disclosure relates to an antenna device having a patch antenna.

Background Art

A patch antenna formed on a dielectric substrate has been used for a radar apparatus, for example, on a mobile unit, including a vehicle and an airplane, for monitoring the surroundings of the mobile unit. Commonly, in the configuration of a patch antenna, a patch radiating element (a patch-shaped conductor) is formed on a dielectric substrate. Generally, a conductor part serving as a ground plane is formed on a face of the dielectric substrate (in the following, referred to as "a substrate rear face") on the opposite side of a face on which the patch radiating element is formed (in the following, referred to as "a substrate front face"). Also on the substrate front face, a conductor part is sometimes widely formed to substrate end portions in addition to the patch radiating element.

In a patch antenna in this configuration, upon operating the patch antenna, electric current (surface current) flows through the surface of the ground plane due to an electric field formed across the patch radiating element and the ground plane. The surface current is propagated to the substrate end portions, and diffracted at the substrate end portions. Because of the influence of the diffracted waves, radiation (emission) occurs from the substrate end portions. In the case where a conductor part is formed on the substrate front face, the surface current also flows through the conductor part to cause radiation from the substrate end portions. Radiation from the substrate end portions due to this surface current is unnecessary radiation that adversely affects the performance of the patch antenna. In other words, radiation from the end portions disturbs the directivity of the patch antenna.

JP-T-2002-510886 discloses a technique to reduce surface current flowing through a ground plane. Specifically, a plurality of conductive patches is formed around a patch radiating element on the substrate front face of a dielectric substrate. The conductive patches are each electrically connected to a ground plane on the rear face of the substrate with a columnar connector (in the following, referred to as "a conducting via"). The structure configured of the conductive patch and the conducting via has a band gap (an electromagnetic band gap) that prevents the propagation of the surface current from flowing through the ground plane at a specified frequency. In the following, the structure configured of the conductive patch and the conducting via is referred to as "an EBG".

In this manner, forming a large number of EBGs around the patch radiating element allows a reduction in the propagation of the surface current to the substrate end portions. Thus, the disturbance in the directivity of the patch antenna can be reduced.

CITATION LIST

Patent Literature

[PTL 1] JP-T-2002-510886

A tolerance with a predetermined margin is set to the outer diameter of the conducting via configuring the EBG (in the following, referred to as "a via diameter"). Thus, the via diameter of the conducting via is varied within a tolerance range. A variation in the via diameter causes the operating frequency band of the EBG, which is a band that can reduce the propagation of the surface current, to fluctuate from its designed operating frequency band. This is likely to cause disturbance (ripples) in the directivity of the patch antenna.

SUMMARY

Hence, it is desired to provide an antenna device is formed with a patch antenna and a conductive structure on a substrate. The conductive structure is a structure having a conductor pattern and a connection conductor for connecting the conductor pattern to a ground plane on the rear face of the substrate. In the antenna device, fluctuations in the operating frequency of the conductive structure due to the tolerance of the connection conductor are reduced, thereby reducing the disturbance in the directivity of the patch antenna due to the conductive structure, even though the dimensions of the connection conductor are varied.

An antenna device according to the present disclosure includes a dielectric substrate and a patch antenna. The dielectric substrate has a ground plane formed on one of plate faces. The patch antenna has at least one patch radiating element for supplying electric power formed on a plate face on the opposite side of the plate face of the dielectric substrate on which the ground plane is formed. The patch antenna has a dominant polarization direction in a predetermined direction of the plate faces of the dielectric substrate. The antenna device according to the present disclosure includes a plurality of conductive structures. The conductive structure includes a patch-shaped conductor pattern formed on a substrate front face that is the plate face of the dielectric substrate on which the patch radiating element is formed. The conductive structure includes a plurality of connection conductors formed across the conductor pattern and the ground plane to penetrate the dielectric substrate for electrically connecting the conductor pattern to the ground plane.

In accordance with the antenna device according to the present disclosure thus configured, a plurality of the conductive structures is formed around the patch radiating element. Thus, the propagation of the surface current from the patch radiating element to the substrate end portions is reduced. Additionally, the conductive structures each have a plurality of the connection conductors, in the configuration in which the plurality of the connection conductors connects the conductor pattern to the ground plane.

As described above, the conductive structure has a plurality of the connection conductors. Thus, even though the dimensions of the connection conductors are varied within a tolerance range, fluctuations in the operating frequency of the conductive structure (the frequency that can reduce the propagation of the surface current) are reduced. Consequently, even though the dimensions of the connection conductor are varied, the effect of reducing the disturbance in the directivity of the patch antenna due to the conductive structure can be maintained.

Note that, reference numerals and signs in parentheses in the claims are examples expressing correspondences with specific means, for example, described in embodiments, described later. The present disclosure is not limited to the specific means, for example, expressed by the reference numerals and signs in the parentheses.

BRIEF DESCRIPTION OF DRAWINGS

In the accompanying drawings:

FIG. 4A is an illustration for explaining the equivalent circuit of an EBG according to the first embodiment (for comparison).

FIG. 4B is an illustration for explaining the equivalent circuit of an EBG according to the first embodiment.

FIG. 5A is an illustration for explaining the relationship between a variation in the via diameter and a variation in the transmission properties of the EBG (the number of conducting vias is one).

FIG. 5B is an illustration for explaining the relationship between a variation in the via diameter and a variation in the transmission properties of the EBG (the number of conducting vias is four).

DETAILED DESCRIPTION OF PREFERRED EMBODIMENTS

Figure 1:
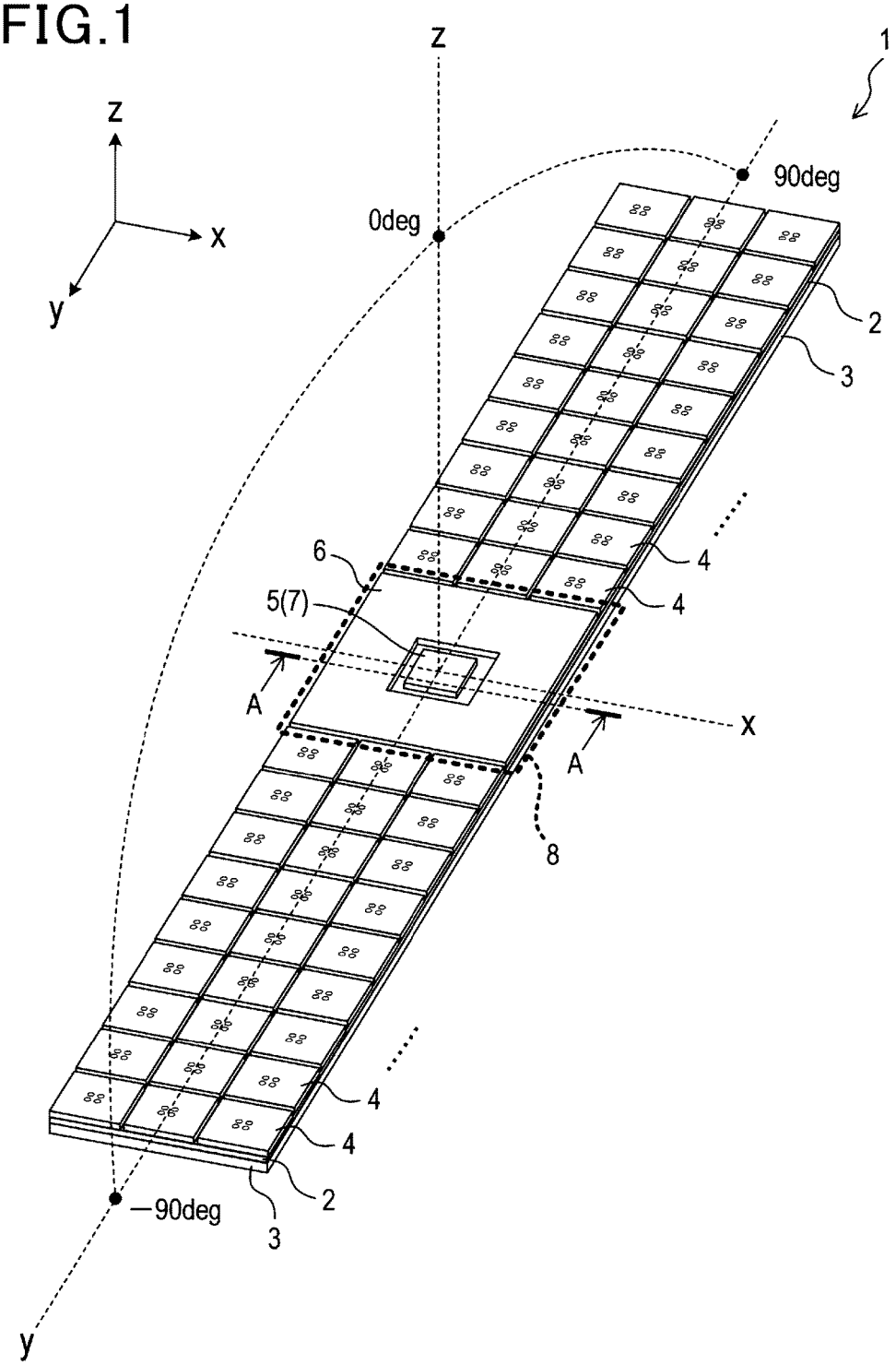
FIG. 1 is a perspective view illustrating the schematic configuration of an antenna device according to a first embodiment.

In the following, referring to the drawings, preferred embodiments of the present disclosure will be described. Note that, the present disclosure is not limited to specific means, structures, and the like described in the embodiments below. The present disclosure can adopt various forms in the scope not deviating from the gist of the present disclosure. For example, a part of the configuration of the embodiment below may be replaced by a publicly known configuration having a similar function. A part of the configuration of the embodiment below may be added to or replaced by the configuration of another embodiment, for example, or may be omitted for solving the problems. Configurations may be provided by appropriately combining the embodiments below.

[First Embodiment]

As illustrated in FIG. 1, in an antenna device 1 according to the present embodiment, a patch antenna 7, a conductor plate 6, and a plurality of EBGs 4 are formed on one face (a substrate front face) of a rectangular dielectric substrate 2. A ground plane 3 formed of a conductor is formed on the other face (a substrate rear face). As illustrated in FIG. 1, the present embodiment will be appropriately described using x-, y-, and z-axes of a three dimensional coordinate system, in which the origin point is the center part of the patch antenna 7 (the center part of a patch radiating element 5, described later), the x-axis is an axis passing the origin point and parallel with the short side of the dielectric substrate 2, the y-axis is an axis passing the origin point and parallel with the long side of the dielectric substrate 2, and the z-axis is an axis passing the origin point and perpendicular to the plate face of the dielectric substrate 2.

Figure 2:
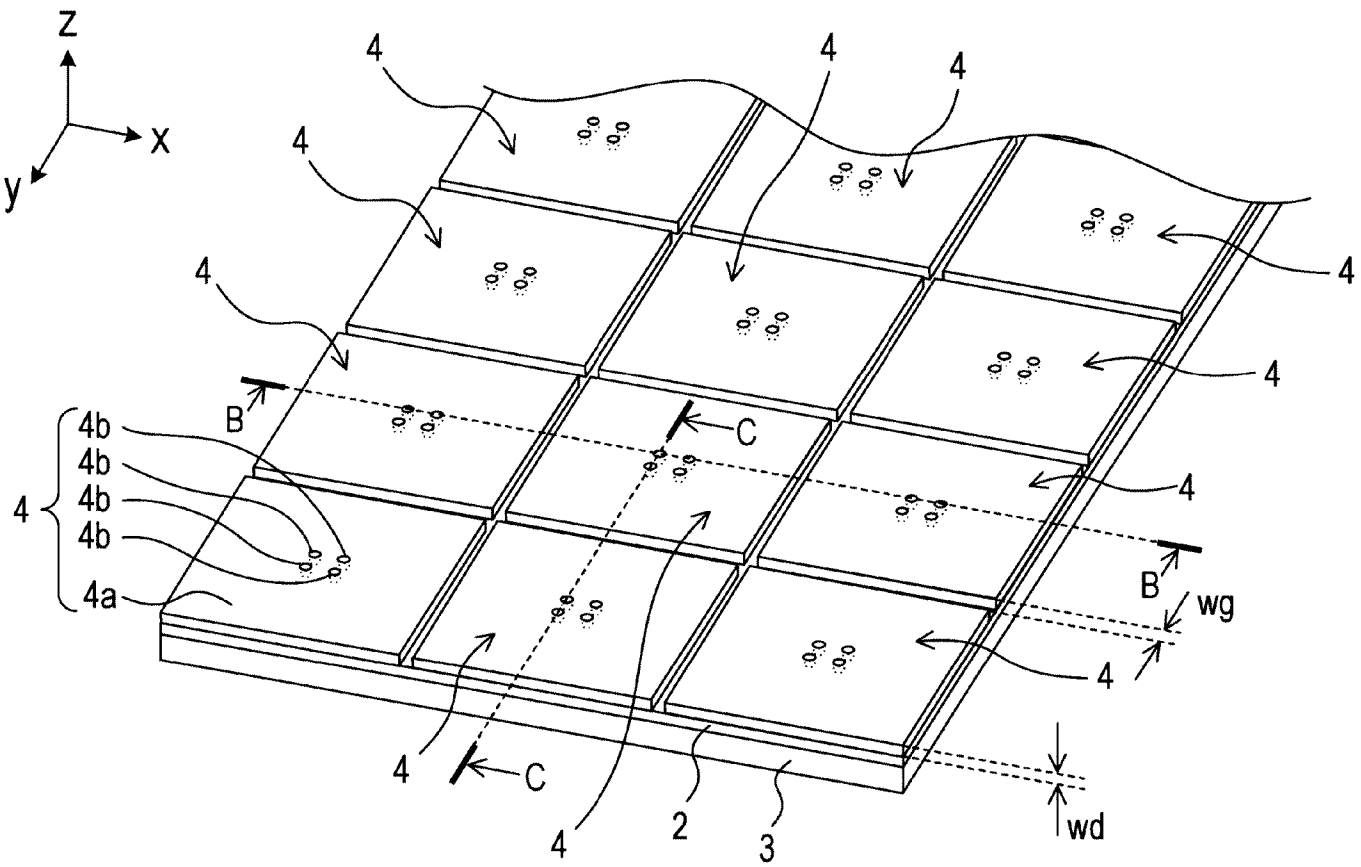
FIG. 2 is a fragmentary enlarged diagram (a perspective view) of the antenna device according to the first embodiment.
Figure 3A:
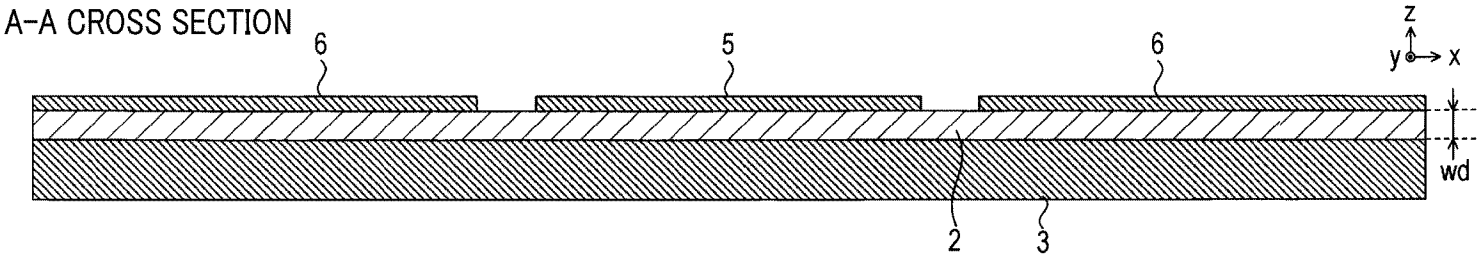
FIG. 3A is a cross sectional view of the antenna device according to the first embodiment taken along line A-A in FIG. 1.
Figure 3B:
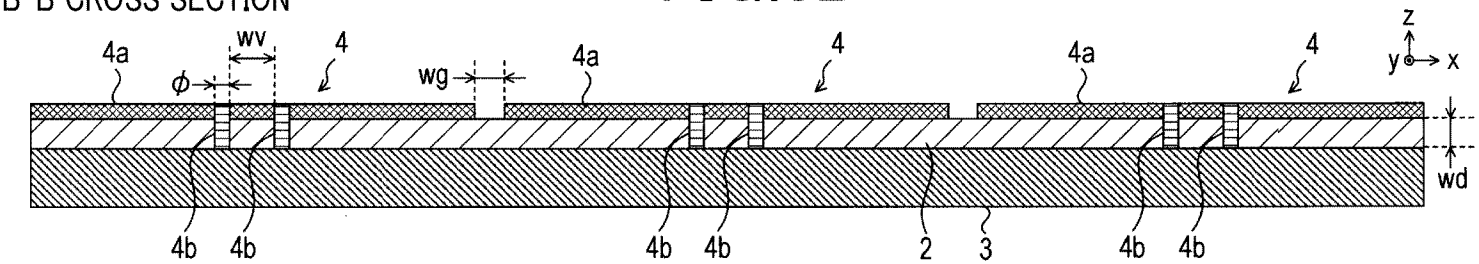
FIG. 3B is a cross sectional view of the antenna device according to the first embodiment taken along line B-B in FIG. 2.
Figure 3C:
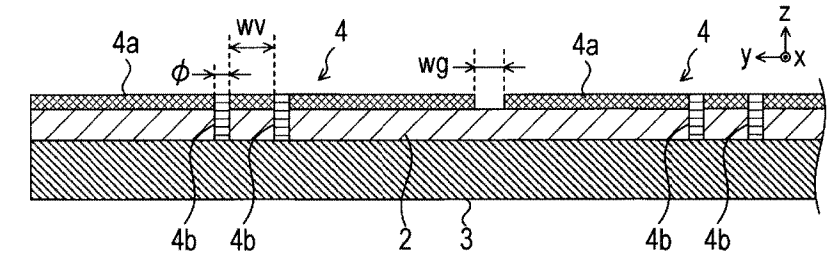
FIG. 3C is a cross sectional view of the antenna device according to the first embodiment taken along line C-C in FIG. 1.

Note that, FIG. 2 is a detailed diagram (enlarged diagram) illustrating the end portion of the antenna device 1 in the y-axis direction, and the vicinity thereof. FIG. 3A is a cross sectional view of the antenna device 1 taken along line A-A (see FIG. 1). FIG. 3B is a cross sectional view of the antenna device 1 taken along line B-B (see FIG. 2). FIG. 3C is a cross sectional view of the antenna device 1 taken along line C-C (see FIG. 2).

The patch antenna 7 has the patch radiating element 5 having a square shape. The patch radiating element 5 is formed on the center part of the substrate front face. The ground plane 3 on the rear face of the substrate functions as a ground plane for the patch radiating element 5. The patch radiating element 5 formed in a square shape is disposed in such a manner that a pair of opposing edges are parallel with each other in the x-axis direction and another pair of opposing edges are parallel with each other in the y-axis direction.

As apparent from FIGS. 1 and 3A, the conductor plate 6 is formed around the patch radiating element 5. However, a groove is formed between the conductor plate 6 and the patch radiating element 5 all around the edges of the patch radiating element 5. The patch radiating element 5 is physically apart from the conductor plate 6 with the groove.

The length of one edge of the patch radiating element 5 is about $\lambda g/2$. Note that, kg is a wavelength corresponding to the operating frequency of the patch antenna 7, which is a wavelength in the inside of the dielectric. $\lambda g$ is expressed by $\lambda g=\lambda 0/\sqrt{\in r}$, where the free space wavelength is defined as $\lambda 0$ and the relative dielectric constant of the dielectric substrate 2 is defined as $\in r$. However, a length of about $\lambda g/2$ is an example of length. For example, the optimum length is changed depending on various factors, such as the shape or size of the ground plane 3.

For supplying electric power to the patch antenna 7, electric power is supplied to the patch radiating element 5. A configuration of power supply to the patch radiating element 5 is omitted in the drawings. Various methods for supplying power to a patch-shaped radiating element have been developed and practically used. Hence, the detailed description is omitted. In the present embodiment, a power supply configuration is provided, in which electric power is supplied from power supply microstrip lines by an electromagnetic coupling power supply method.

The patch antenna 7 operates as the y-axis direction is the dominant polarization direction. In other words, the patch antenna 7 is configured as an antenna to operate as the yz plane is the plane of polarization (the E-plane) and to allow excellent transmission and reception of polarized waves on the yz plane.

For example, the antenna device 1 is disposed in such a manner that on the front side of a vehicle, the substrate front face, on which the patch antenna 7 is formed, faces the front side of the vehicle and the long sides of the rectangular dielectric substrate 2 (the edges in the y-axis direction) are horizontally disposed with respect to the ground. The antenna device 1 is used for a millimeter wave radar apparatus to monitor the areas around the vehicle. In other words, when the antenna device 1 is mounted on the vehicle for use, the E-plane of the patch antenna 7 is horizontally disposed with respect to the ground. Thus, the patch antenna 7 is used as an antenna capable of favorably transmits and receives horizontally polarized waves. Note that, in the following description, the E-plane (the yz plane) of the patch antenna 7 is also referred to as a horizontal plane.

As illustrated in FIG. 1, in the present specification, the azimuth angle (sensing angle) on the horizontal plane (the E-plane) of the patch antenna 7 is treated in such a manner that based on the z-axis direction) (0°), angles on the left side of the patch antenna 7 are positive angles and angles on the right side are negative angles when the front side of the vehicle is viewed from the patch antenna 7.

As also apparent from FIGS. 2, 3B, and 3C, the EBG 4 has a patch-shaped metal pattern (in the following, referred to as "a patch-shaped pattern") 4*a* formed on the substrate front face of the dielectric substrate 2 and four conducting vias 4*b* to electrically connect this patch-shaped pattern 4*a* to the ground plane 3. All of the patch-shaped pattern 4*a* and the four conducting vias 4*b* are conductors. A specific shape (the shape of a face in parallel with the substrate plate face) of the patch-shaped pattern 4*a* according to the present embodiment is a square shape.

All of the four conducting vias 4*b* are columnar conductors having an outer diameter (via diameter) φ. As illustrated in detail in FIGS. 3B and 3C, the conducting vias 4*b* are provided so as to penetrate the dielectric substrate 2 in a thickness wd in a direction perpendicular to the plate face of the dielectric substrate 2 (in the z-axis direction). One end is connected to the patch-shaped pattern 4*a*. The other end is connected to the ground plane 3.

A plurality of the EBGs 4 is provided on the antenna device 1. Specifically, throughout the region on the substrate front face other than an EBG absent region 8 (see FIG. 1), a plurality of the patch-shaped patterns 4*a* is arrayed with a predetermined pattern gap wg apart. The wavelength of the pattern gap wg is much shorter than a wavelength corresponding to the use frequency of the antenna device 1. All the patch-shaped patterns 4*a* are disposed in such a manner that a pair of opposing edges is in parallel with each other in the x-axis direction and another pair of opposing edges is in parallel with each other in the y-axis direction.

In the present embodiment, throughout the region on the substrate front face other than the EBG absent region 8, a plurality of the patch-shaped patterns 4*a* is disposed with the pattern gap wg therebetween. As illustrated in FIG. 1, on one end side of the dielectric substrate 2 in the y-axis direction when viewed from the patch radiating element 5, the patch-shaped patterns 4*a* are disposed in three rows in the x-axis direction and in nine rows in the y-axis direction. Also on the other end side of the dielectric substrate 2 in the y-axis direction when viewed from the patch radiating element 5, the patch-shaped patterns 4*a* are disposed in three rows in the x-axis direction and in nine rows in the y-axis direction similarly to the patch-shaped patterns 4*a* on one end side.

One end of each of the four conducting vias 4*b* of the EBGs 4 is connected to the center region of the patch-shaped pattern 4*a*. Specifically, the conducting vias 4*b* are connected in such a manner that the connecting portion of the conducting via 4*b* is arranged in two rows in the x-axis direction and in two rows in the y-axis direction on the patch-shaped pattern 4*a*. In other words, a group is formed of two conducting vias 4*b* arrayed in a row with a predetermined connection gap wv apart in the x-axis direction perpendicular to the E-plane. Two groups are arrayed side by side in the y-axis direction with the connection gap wv apart. The trace formed by connecting the connecting portions of the four conducting vias 4*b* is a square. In the present embodiment, the center of the square is matched with the center of the patch-shaped pattern 4*a*.

The EBG absent region 8 is a region in which the patch radiating element 5 is present in its center part and no patch-shaped pattern 4*a* is present. The EBG absent region 8 is in a square shape as a whole. In the present embodiment, in the center of the EBG absent region 8, the patch radiating element 5 is disposed. On nearly the entire region except the patch radiating element 5, the conductor plate 6 is formed. Note that, the conductor plate 6 is indirectly electrically connected to the ground plane 3 on the rear face of the substrate, but the conductor plate 6 functions as the ground of the patch antenna 7 together with the ground plane 3 on the rear face of the substrate. However, the conductor plate 6 is not an essential component of the antenna device 1. The conductor plate 6 may be omitted.

The EBGs 4 are capacitively coupled to adjacent EBGs 4, and inductively and capacitively coupled to the ground plane 3 on the rear face of the substrate. Thus, the EBGs 4 function as a two-dimensional circuit network of a parallel resonant circuit as a whole, and reduce the propagation of a surface current to both ends of the substrate (to both ends in the dominant polarization direction). The surface current is produced by the operation (radiation) of the patch antenna 7.

The equivalent circuit of the EBG 4 according to the present embodiment is as illustrated in FIG. 4B. Note that, FIG. 4A also illustrates the equivalent circuit of an EBG (comparative EBG) 100 having one conducting via for comparison.

As illustrated in FIG. 4A, the comparative EBG 100 has a patch-shaped pattern 100*a* and a conducting via 100*b*. In the comparative EBG 100, a capacitive component (capacitance) $CL_1$ is provided by capacitively coupling the comparative EBG 100 to another adjacent comparative EBG 100 with the pattern gap wg apart. An inductive component (inductance) $LR_1$ is provided by the patch-shaped pattern 100*a*. An inductive component $L_L$ is provided across the patch-shaped pattern 100*a* and the ground plane 3 by the conducting via 100*b*. In parallel with the inductive component $L_L$, a capacitance component $C_{R1}$ is provided across the patch-shaped pattern 100*a* and the ground plane 3. Thus, the equivalent circuit of the comparative EBG 100 is a circuit as illustrated in FIG. 4A.

Unlike the comparative EBG 100, the EBG 4 according to the present embodiment has four conducting vias 4*b* in the same size and shape of the conducting via 100*b* of the comparative EBG 100. Thus, as illustrated in an equivalent circuit in FIG. 4B, inductive components $L_{L1}$, $L_{L2}$, $L_{L3}$, and $L_{L4}$ by the conducting vias 4*b* are present in parallel with one another across the patch-shaped pattern 4*a* and the ground plane 3. Therefore, the inductive components across the patch-shaped pattern 4*a* and the ground plane 3 have the parallel combined values of these four inductive components $L_{L1}$, $L_{L2}$, $L_{L3}$, and $L_{L4}$.

Note that, the values (inductance values) of the four inductive components $L_{L1}$, $L_{L2}$, $L_{L3}$, and $L_{L4}$ are the same. Each of these four inductance values is the same as the inductance value $L^L$ of the conducting via 100*b* of the comparative EBG 100. Thus, the four parallel combined inductances have values smaller than each of the inductance values.

In order to reduce the propagation of the surface current (the surface wave) at an operating frequency fc of the patch antenna 7 using the comparative EBG 100 and the EBG 4 according to the present embodiment, the resonance frequency of the LC parallel circuit formed across the patch-shaped pattern and the ground plane 3 is desirably set to the operating frequency fc of the patch antenna 7.

In other words, in the comparative EBG 100, the capacitance component $C_{R1}$ and the inductive component $L_L$ configuring the LC parallel circuit desirably satisfy Expression (1) below.

[Math. 1]

$$f_c = \frac{1}{2\pi\sqrt{L_L C_{R1}}} \tag{1}$$

On the other hand, in the EBG 4 according to the present embodiment, a capacitance component $C_{R2}$ and the four inductive components $L_{L1}$ to $L_{L4}$ configuring the LC parallel circuit desirably satisfy Expression (2) below.

[Math. 2]

$$f_c = \frac{1}{2\pi\sqrt{L_{LP} C_{R2}}} \tag{2}$$

where $L_{Lp} = L_{L1} // L_{L2} // L_{L3} // L_{L4}$

Note that, the parallel combined values of the four inductive components $L_{L1}$, $L_{L2}$, $L_{L3}$, and $L_{L4}$ are basically expressed by Expression (3) below as known.

[Math. 3]

$$L_{L1} // L_{L2} // L_{L3} // L_{L4} = \frac{1}{\frac{1}{L_{L1}} + \frac{1}{L_{L2}} + \frac{1}{L_{L3}} + \frac{1}{L_{L4}}} = \frac{L_L}{4} \tag{3}$$

However, the operating frequency fc of the patch antenna 7 according to the present embodiment is in a high frequency band in the GHz band. Thus, coupling at high frequency range is produced among the four conducting vias 4*b*. Because of this coupling, an actual parallel combined value $L_{LP}$ of the four inductive components $L_{L1}$, $L_{L2}$, $L_{L3}$, and $L_{L4}$ is a value greater than a value obtained by the basic arithmetic expression expressed by Expression (3) above.

As already described, in the EBG 4 according to the present embodiment, the parallel combined inductance value $L_{LP}$ of the LC parallel circuit is a value of about ¼ (slightly greater than ¼) of the inductance value $L_L$ produced by one conducting via 4*b*. The parallel combined inductance value $L_{LP}$ is formed across the patch-shaped pattern 4*a* and the ground plane 3. Thus, the value of the capacitance component $C_{R2}$ is a value greater than the value of the capacitance component $C_{R1}$ of the comparative EBG 100. Specifically, the value of the capacitance component $C_{R2}$ is a value slightly smaller than a value four times the value of the capacitance component $C_{R1}$ of the comparative EBG 100.

Consequently, in the EBG 4 according to the present embodiment, the area of the patch-shaped pattern 4*a* is formed slightly smaller than the area four times the area of the patch-shaped pattern 100*a* of the comparative EBG 100.

In other words, in the EBG 4 according to the present embodiment, the parallel combined inductance value $L_{LP}$ of the LC parallel circuit formed across the patch-shaped pattern 4*a* and the ground plane 3 is a value smaller than the inductance value $L_L$ of the LC parallel circuit of the comparative EBG 100 (about ¼). Thus, the area of the patch-shaped pattern 4*a* is formed greater than the area of the comparative EBG 100, whereby the capacitance component $C_{R2}$ has a greater value. Consequently, the LC parallel circuit formed across the patch-shaped pattern 4*a* and the ground plane 3 is designed in such a manner that the resonance frequency of the LC parallel circuit is matched with the operating frequency fc of the patch antenna 7 as a whole.

In summary, the design conditions of the EBG 4 according to the present embodiment can be expressed by Expression (2) above and Expression (4) below. Note that, in Expression (4) below, β is a phase constant.

[Math. 4]

$$\beta = \sqrt{\omega_c^2 + L_{R2}C_{R2} + \frac{1}{\omega_c^2 L_{LP} C_{L2}} - \left(\frac{L_{R2}}{L_{Lp}} + \frac{C_{R2}}{C_{L2}}\right)} \tag{4}$$

where $\omega_c = 2\pi f_C$

In the antenna device 1 according to the present embodiment, taking into account of Expressions (2) and (4) above and the thickness wd and relative dielectric constant of the dielectric substrate 2, for example, the dimensions and other parameters of the parts of the EBG 4 are designed. The dimensions and other parameters of the parts of the EBG 4 are the shape and dimensions of the patch-shaped pattern 4*a*, the via diameter φ of the conducting via 4*b*, the connection gap wv between the four conducting vias 4*b*, and the pattern gap wg between the adjacent patch-shaped patterns 4*a*, for example. The EBG 4 is designed in such a manner that Expressions (2) and (4) above are satisfied. Thus, the operating frequency (the surface current cutoff frequency) of the EBG can be matched with the operating frequency fc of the patch antenna 7. Consequently, the propagation of the surface current to the substrate end portions can be favorably reduced.

A tolerance with a predetermined margin is set to the via diameter φ of the conducting via 4*b* configuring the EBG 4. This causes a variation in the via diameter φ of the conducting via 4*b* within a tolerance range. A variation in the via diameter is likely to displace the operating frequency band of the EBG 4 from the designed operating frequency band (a predetermined band including the operating frequency fc of the patch antenna 7 as an approximate center frequency), resulting in the degradation of the performance of the EBG 4. Specifically, because of the configuration, the EBG 4 has a high Q-value and a narrow cutoff band. Even a slight displacement from the design value of the via diameter φ is likely to relatively greatly affect the performance of the EBG 4 (even though a displacement is taken place within a tolerance range).

Therefore, in the present embodiment, the EBG 4 is provided with a plurality of the conducting vias 4*b*, which are a principal factor to determine the operating frequency, to one patch-shaped pattern 4*a*. In the present embodiment, four conducting vias 4*b* are provided. One patch-shaped pattern 4*a* is provided with a plurality of the conducting vias 4*b*. Thus, the combined inductive component ($L_{LP}$) in Expression (2) is smaller than the inductive component ($L_L$) in Expression (1), and the capacitance component ($C_{R2}$) becomes dominant. Consequently, a displacement in the conducting via gives a small influence, compared with Expression (1). The operating frequency fc is less affected. However, in Expression (2), the area of the patch shape forming the capacitance component is greater than in Expression (1).

FIG. 5A shows three patterns of the transmission properties of a via diameter φo of the conducting via 100*b* of the comparative EBG 100, in which the via diameter φo has the designed reference value, which is 150 μm, the via diameter φo is shorter than the reference value, which is 130 μm, and the via diameter φo is longer than the reference value, which is 170 μm. Note that, the via diameters φo in these three patterns are all included within a tolerance range.

On the other hand, FIG. 5B shows three patterns of the transmission properties of the four conducting vias 4*b* of the EBG 4 according to the present embodiment, in which the via diameter φ of each of the four conducting vias 4*b* has the designed reference value, which is 150 μm, the via diameter φ of each of the four conducting vias 4*b* is shorter than the reference value, which is 130 μm, and the via diameter φ of each of the four conducting vias 4*b* is longer than the reference value, which is 170 μm.

As illustrated in FIG. 5A, in the comparative EBG 100, when the via diameter φo of the conducting via 100*b* is varied within a range of the reference value ±20 μm, the operating frequency (the cutoff frequency) is varied in a range of about 1.5 GHz as a whole. However, as illustrated in FIG. 5B, in the EBG 4 according to the present embodiment, when the via diameter φ of the conducting via 4*b* is varied within a range of the reference value ±20 μm, fluctuations in the operating frequency (the cutoff frequency) are in a range of about 0.3 GHz. Thus, fluctuations in the operating frequency of the EBG 4 are greatly reduced, compared with fluctuations in the operating frequency of the comparative EBG 100.

Figure 6A:
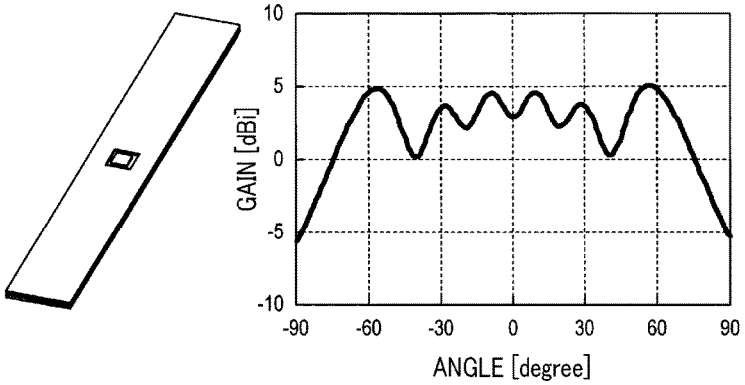
FIG. 6A is an illustration of the directivity of an antenna device according to comparative example 1.
Figure 6B:
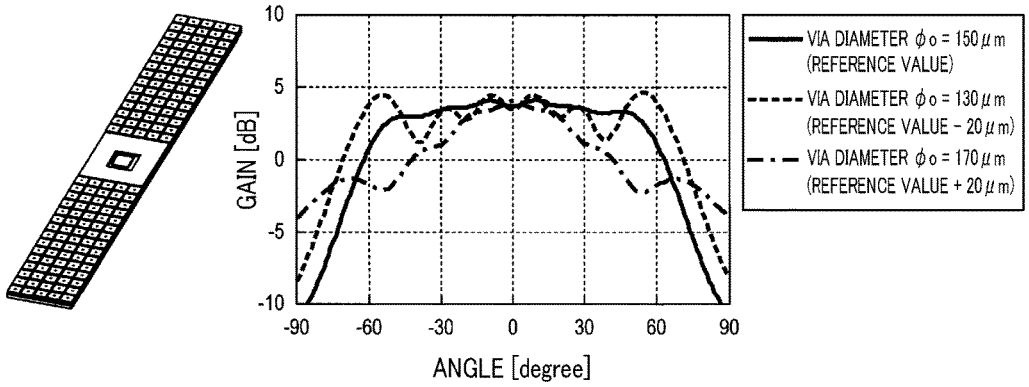
FIG. 6B is an illustration of the directivity of an antenna device according to comparative example 2.
Figure 6C:
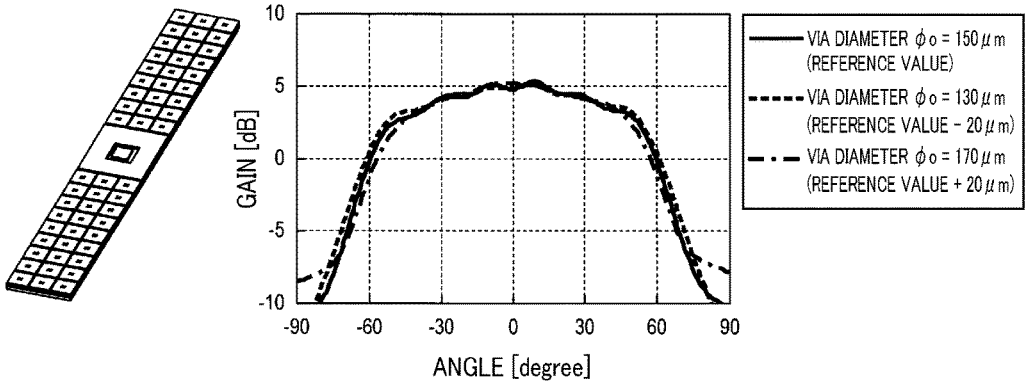
FIG. 6C is an illustration of the directivity of the antenna device according to the first embodiment.

Referring to FIGS. 6A to 6C, differences in the directivity of the antenna device caused by the presence or absence of the EBG and the number of conducting vias configuring the EBG will be described. FIG. 6A shows the directivity of an antenna device formed with no EBG (comparative example 1). In the antenna device according to comparative example 1, a patch radiating element 5 is formed in the center part of a dielectric substrate 2, which is similar to the present embodiment. However, a conductor plate is formed around the patch radiating element 5 nearly throughout the surface.

FIG. 6B shows the directivity of an antenna device formed with a plurality of EBGs, each having one conducting via (comparative example 2). The antenna device according to comparative example 2 has a configuration in which the comparative EBGs 100 (see FIG. 4A) are formed throughout the region in which the EBGs 4 are formed in the antenna device 1 according to the present embodiment.

FIG. 6C shows the directivity of the antenna device 1 according to the present embodiment formed with a plurality of the EBGs 4, each having four conducting vias.

In the case of the antenna device with no EBG according to comparative example 1, the surface current is propagated to the substrate end portions, and radiation occurs from the substrate end portions. Thus, as illustrated in FIG. 6A, in the directivity of the antenna according to comparative example 1, the gain is decreased (ripples occur) in a specific direction (e.g. around a direction at an angle of ±45°).

On the other hand, in the case of the antenna device formed with the comparative EBGs 100 according to comparative example 2, an effect is obtained, in which the surface current is reduced by the comparative EBGs 100. Thus, as illustrated in FIG. 6B, in the directivity of the antenna according to comparative example 2, a decrease in gain in a specific direction is reduced, compared with comparative example 1.

However, as apparent from FIG. 6B, the displacement of the via diameter φo of the conducting via 100*b* of the comparative EBG 100 from the designed reference value causes disturbance in directivity, compared with the case in which the via diameter φo has the reference value. When the conducting via 100*b* is varied within a tolerance range, which is accepted in manufacture, the operating frequency of the comparative EBG 100 is also greatly varied, as described with reference to FIG. 5A. A great variation in the operating frequency causes disturbance in directivity as illustrated in FIG. 6B.

However, the antenna device 1 according to the present embodiment has the configuration in which a plurality of the conducting vias 4*b* (four conducting vias 4*b*) is connected to one patch-shaped pattern 4*a*. As described with reference to FIG. 5B, in the EBG 4 in this configuration, even though the via diameter φ is varied, fluctuations in the operating frequency are small, compared with the comparative EBG 100. Consequently, as illustrated in FIG. 6C, the directivity of the antenna device 1 is not disturbed so much when the via diameter φ is varied, and the effect of reducing ripples can be sufficiently obtained.

In accordance with the antenna device 1 according to the present embodiment described above, a plurality of the EBGs 4 is formed around the patch radiating element 5. Thus, the propagation of the surface current from the patch radiating element 5 to the substrate end portions is reduced. Additionally, each of the EBGs 4 has a plurality of the conducting vias 4*b* in the configuration in which the plurality of conducting vias 4*b* connects one patch-shaped pattern 4*a* to the ground plane 3.

The EBG 4 has a plurality of the conducting vias 4*b* as described above. Thus, even though the via diameter φ of each of the conducting vias 4*b* is varied within a tolerance range, fluctuations in the operating frequency of the EBG 4 are reduced. Consequently, even though the via diameter φ of the conducting via 4*b* is varied, the effect of reducing the disturbance in the directivity of the patch antenna 7 caused by the EBGs 4 can be maintained.

Note that, the four conducting vias 4*b* configuring the EBG 4 are disposed close to the center region of the patch-shaped pattern 4*a*. Because of the characteristics of high frequency, the impedance characteristics of the conducting vias 4*b* are changed depending on the locations at which the conducting vias 4*b* are disposed (the locations, at which the conducting vias 4*b* are disposed, depend on wavelengths). Thus, the plurality of conducting vias 4*b* is densely disposed, allowing the impedance characteristics of the conducting vias 4*b* to be made uniform. Therefore, densely disposing the plurality of conducting vias configuring the EBG is effective in reducing fluctuations in the operating frequency of the EBG caused by a variation in the via diameter φ, which in turn leads to effectiveness in reducing ripples in the directivity of the patch antenna more than in disposing the conducting vias apart from one another.

In the antenna device 1, the EBGs 4 are not disposed all around the patch radiating element 5 on the substrate front face. The EBGs 4 are disposed on the outer side of the EBG absent region 8 including the patch radiating element 5. As described above, the region in which the EBGs 4 are absent is provided around the patch radiating element 5. Thus, an excess cutoff of the surface current is reduced, resulting in preventing the beam width of the directivity of the patch antenna 7 from being narrowed.

[Second Embodiment]

Figure 7A:
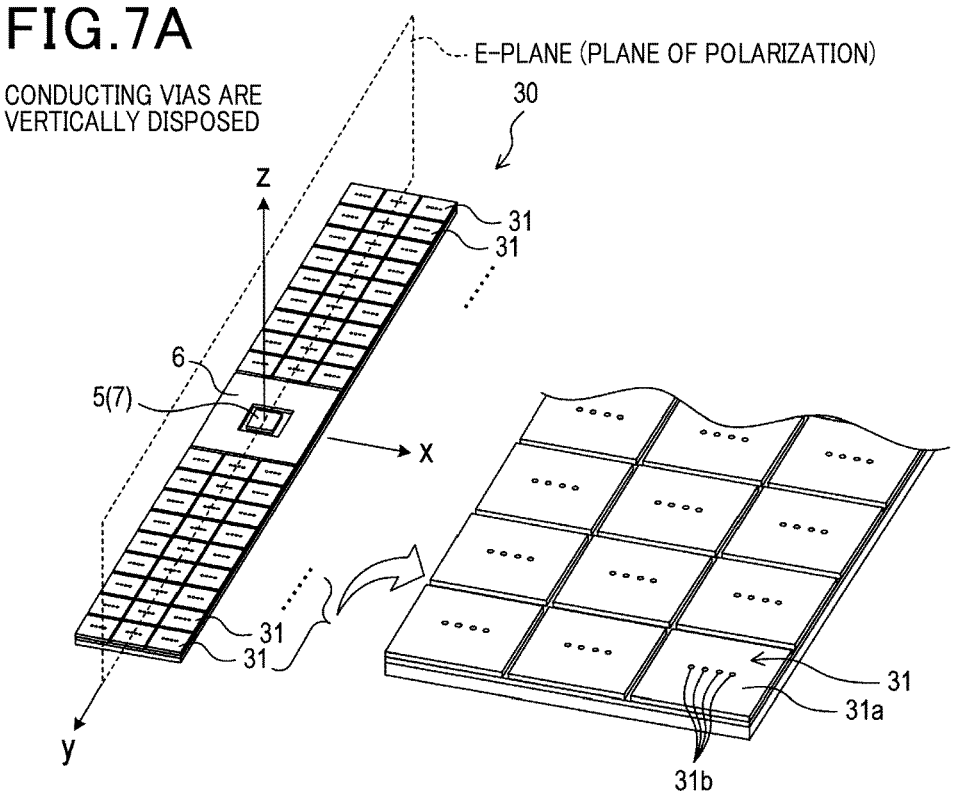
FIG. 7A is a perspective view illustrating the schematic configuration of an antenna device according to a second embodiment, in which conducting vias are vertically disposed.
Figure 7B:
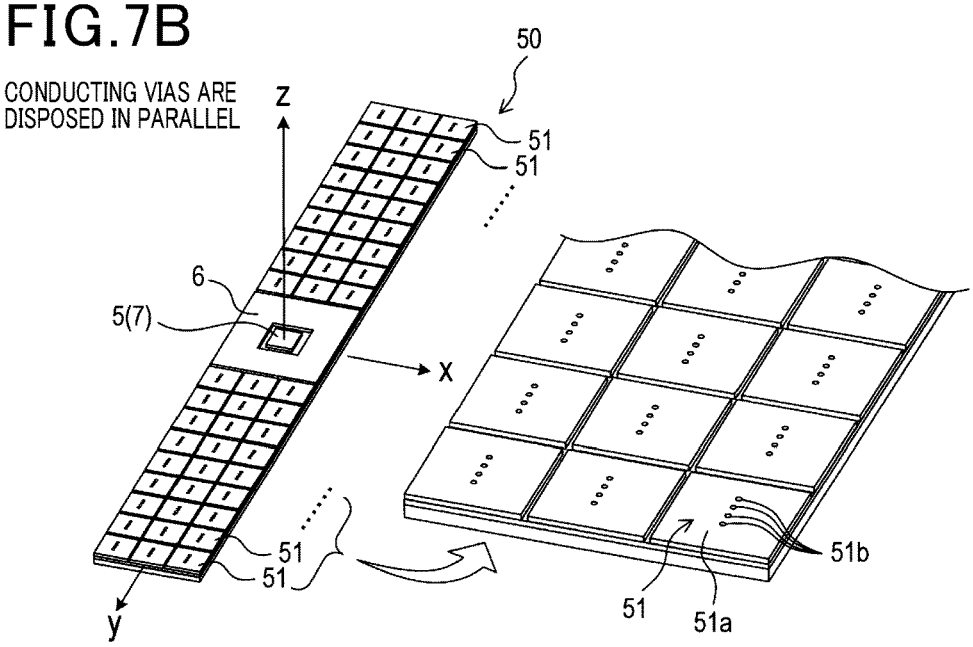
FIG. 7B is a perspective view of the schematic configuration of an antenna device according to the second embodiment, in which conducting vias are disposed in parallel.

As illustrated in FIGS. 7A and 7B, in the present embodiment, two antenna devices 30 and 50 will be described. The two antenna devices 30 and 50 illustrated in FIGS. 7A and 7B have array structures of a plurality of conducting vias of an EBG different from that of the antenna device 1 according to the first embodiment illustrated in FIG. 1. The other configurations are the same as the configurations of the antenna device 1 according to the first embodiment.

First, the antenna device 30 illustrated in FIG. 7A will be described. In the antenna device 30 illustrated in FIG. 7A, a plurality of EBGs 31 each includes one patch-shaped pattern 31*a* and four conducting vias 31*b*. The shape and dimensions of the patch-shaped pattern 31*a* are the same as the shape and dimensions of the patch-shaped pattern 4*a* of the EBG 4 according to the first embodiment. The shape and dimensions of each of the four conducting vias 31*b* are the same as the shape and dimensions of the conducting via 4*b* of the EBG 4 according to the first embodiment. However, the array form of these four vias is different from the array form in the EBG 4 according to the first embodiment. In the present embodiment, the four conducting vias 31*b* are arrayed in a row. The array direction is the direction perpendicular to the plane of polarization (the E-plane) of the patch antenna 7 (i.e. the x-axis direction).

Next, the antenna device 50 illustrated in FIG. 7B will be described. In the antenna device 50 illustrated in FIG. 7B, a plurality of EBGs 51 each includes one patch-shaped pattern 51*a* and four conducting vias 51*b*. The shape and dimensions of the patch-shaped pattern 51*a* are the same as the shape and dimensions of the patch-shaped pattern 4*a* of the EBG 4 according to the first embodiment. The shape and dimensions of each of the four conducting vias 51*b* are the same as the shape and dimensions of the conducting via 4*b* of the EBG 4 according to the first embodiment. However, the array form of these four vias is different from the array form in the EBG 4 according to the first embodiment and the array form in the EBG 31 in FIG. 7A. In the antenna device 50 in FIG. 7B, the four conducting vias 51*b* are arrayed in a row on the plane of polarization (the E-plane) of the patch antenna 7. The array direction is the direction in parallel with the plane of polarization (the E-plane) of the patch antenna 7 (i.e. the y-axis direction).

In both of the antenna devices 30 and 50 in FIGS. 7A and 7B thus configured, the EBG includes a plurality of conducting vias. Thus, similarly to the antenna device 1 according to the first embodiment, even though the via diameter of the conducting via is varied, fluctuations in the operating frequency of the EBG can be reduced, compared with the antenna device including the EBG with one conducting via.

On the other hand, in relative comparison among the antenna device 1 according to the first embodiment and the two antenna devices 30 and 50 illustrated in FIGS. 7A and 7B, the effect of reducing fluctuations in the operating frequency of the EBG caused by a variation in the via diameter is different among the antenna devices 1, 30, and 50.

Figure 8:
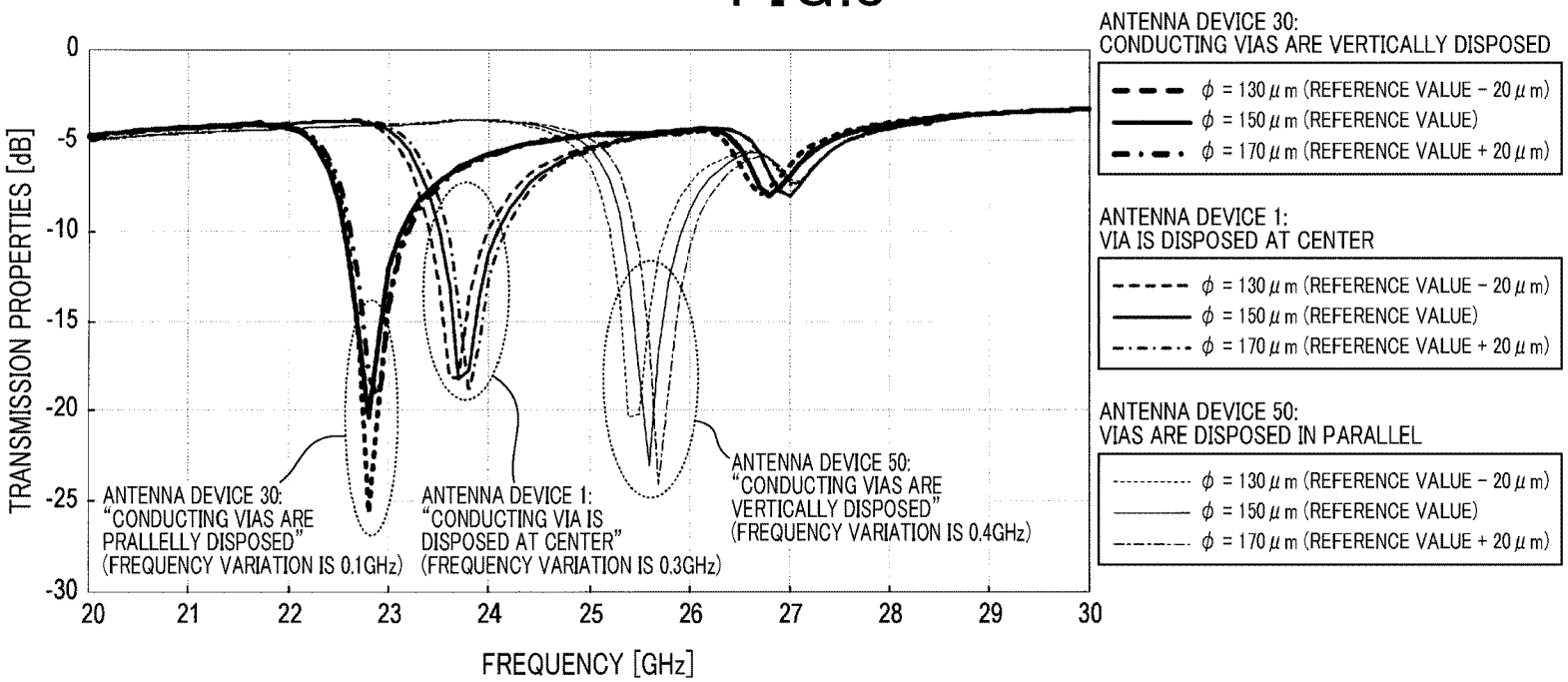
FIG. 8 is an illustration of the relationship between the array form of a plurality of conducting vias configuring an EBG and the level of fluctuations in the operating frequency of the EBG caused by a variation in the via diameter.

FIG. 8 shows examples of the transmission properties of the EBGs of the antenna device 1 according to the first embodiment and the two antenna devices 30 and 50 according to the second embodiment. In the antenna device 1 according to the first embodiment, the four conducting vias 4*b* are disposed in the center region of the patch-shaped pattern 4*a* of each of the EBGs 4. Specifically, as described above, two groups each formed of the two conducting vias 4*b* arrayed in a row in the x-axis direction with the connection gap wv apart are arrayed in the y-axis direction with the connection gap wv apart.

The transmission properties of the EBG 4 of the antenna device 1 thus configured are changed depending on a variation in the via diameter φ of each of the four conducting vias 4*b* configuring the EBG 4. FIG. 8 shows three patterns of the transmission properties of the EBG 4, in which the via diameter φ of each of the four conducting vias 4*b* matches a designed reference value of 150 μm, the via diameter φ of 130 μm is shorter than the reference value, and the via diameter φ is 170 μm which is longer than the reference value. Note that, the via diameters φo in these three patterns are all included within a tolerance range.

As illustrated in FIG. 8, in the EBG 4 of the antenna device 1 according to the first embodiment, when the via diameter φ of the conducting via 4*b* is varied within a range of the reference value ±20 μm, the operating frequency (the cutoff frequency) is varied in a range of about 0.3 GHz as a whole.

On the other hand, in the antenna device 30 illustrated in FIG. 7A, the four conducting vias 31*b* are arrayed perpendicularly to the plane of polarization on the EBGs 31.

The transmission properties of the EBG 31 of the antenna device 30 thus configured are also changed depending on a variation in the via diameter φ of the four conducting vias 31*b* configuring the EBG 31. FIG. 8 shows the transmission properties of the EBG 31 with the via diameters φ in the different three patterns similarly to the EBG 4 according to the first embodiment.

As illustrated in FIG. 8, in the EBG 31 of the antenna device 30 illustrated in FIG. 7A, when the via diameter φ of the conducting via 31*b* is varied within a range of the reference value ±20 μm, the operating frequency (the cutoff frequency) is varied in a range of about 0.1 GHz as a whole. This variation is smaller than a variation in the EBG 4 according to the first embodiment.

In the antenna device 50 illustrated in FIG. 7B, the four conducting vias 51*b* are arrayed parallel with the plane of polarization on the EBGs 51.

The transmission properties of the EBG 51 of the antenna device 50 thus configured are also changed depending on a variation in the via diameters φ of the four conducting vias 51*b* configuring the EBG 51. FIG. 8 shows the transmission properties of the EBG 51 with the via diameters φ in different three patterns similarly to the EBG 4 according to the first embodiment.

As illustrated in FIG. 8, in the EBG 51 of the antenna device 50 illustrated in FIG. 7B, when the via diameter φ of the conducting via 51*b* is varied within a range of the reference value ±20 μm, the operating frequency (the cutoff frequency) is varied in a range of about 0.4 GHz as a whole.

This variation is slightly greater than a variation in the EBG 4 according to the first embodiment.

The transmission properties in FIG. 8 show the results on the array direction of a plurality of conducting vias configuring the EBG, in which the effect of reducing fluctuations in the operating frequency of the EBG is more enhanced in arraying the vias in the direction different from the plane of polarization than in arraying the vias in parallel with the plane of polarization. In order to more enhance the effect of reducing fluctuations in the operating frequency of the EBG, a plurality of conducting vias is preferably arrayed in the direction perpendicular to the plane of polarization.

[Other Embodiments]

(1) The region in which the EBGs are disposed on the substrate front face can be appropriately determined.

(2) The number of a plurality of conducting vias configuring one EBG can be appropriately determined. A specific shape (e.g. a cross sectional topology) of a plurality of conducting vias can be appropriately determined. The other conditions for a plurality of conducting vias can be appropriately determined, such as locations at which a plurality of conducting vias is connected to the patch-shaped pattern, and which direction vias are arrayed in the case in which a part or all of a plurality of conducting vias is arrayed in a row.

However, in order to enhance the effect of reducing fluctuations in the operating frequency of the EBG caused by a variation in the via diameter of the conducting via, a plurality of conducting vias is preferably disposed close to each other (vias are densely disposed).

Figure 9A:
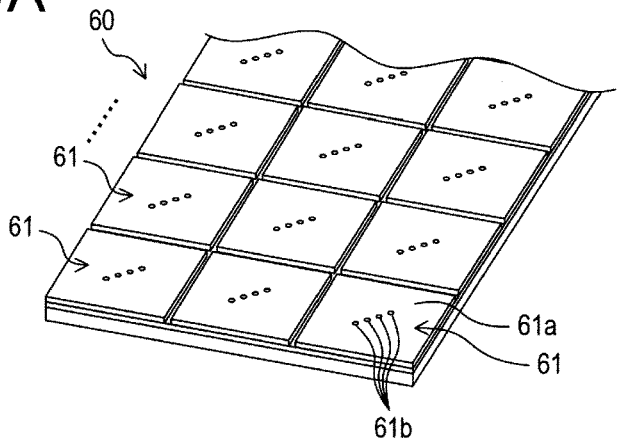
FIG. 9A is an illustration of another example of EBGs configuring an antenna device.
Figure 9B:
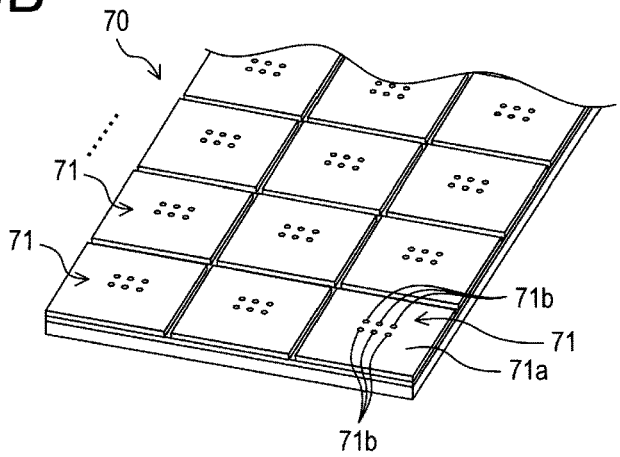
FIG. 9B is an illustration of still another example of EBGs configuring an antenna device.

FIGS. 9A and 9B illustrate other examples of the EBG. In an antenna device 60 illustrated in FIG. 9A, the array form of four conducting vias configuring an EBG is different from that in the antenna device 1 according to the first embodiment illustrated in FIG. 1. Specifically, as illustrated in FIG. 9A, a plurality of EBGs 61 each has four conducting vias 61*b*. The four conducting vias 61*b* are connected to one patch-shaped pattern 61*a*. The direction in which the four conducting vias 61*b* are arrayed is not in parallel with the x-axis or the y-axis.

In the antenna device 70 illustrated in FIG. 9B, the number of conducting vias configuring the EBG and the array form of the vias are different from those in the antenna device 1 according to the first embodiment illustrated in FIG. 1. Specifically, as illustrated in FIG. 9B, a plurality of EBGs 71 each has six conducting vias 71*b*. The six conducting vias 71*b* are connected to one patch-shaped pattern 71*a*. The six conducting vias 71*b* are disposed as three vias are arrayed in two rows. In other words, three conducting vias 71*b* arrayed in a row in the x-axis direction make a group. This group is disposed in two rows in the y-axis direction.

The forms of the EBGs 61 and 71 illustrated in FIGS. 9A and 9B are merely examples. Any forms of the EBG can be variously adopted, other than these forms.

Figure 9C:
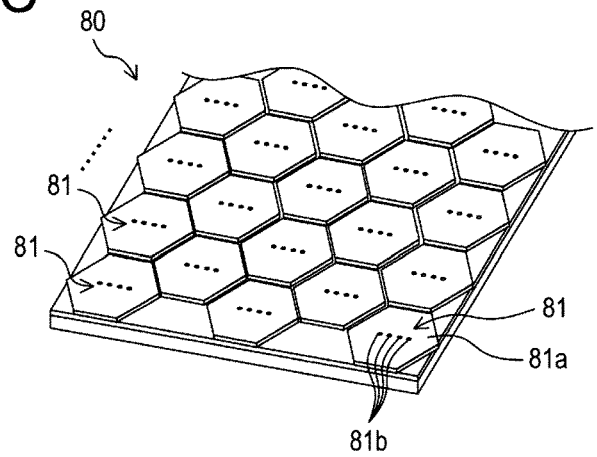
FIG. 9C is an illustration of yet another example of EBGs configuring an antenna device.

(3) For the specific shape of the patch-shaped pattern configuring the EBG, a square shape described in the embodiments is merely an example. The patch-shaped pattern can have any shapes. For example, as illustrated in an antenna device 80 in FIG. 9C, a plurality of EBGs 81 each having a hexagonal patch-shaped pattern 81*a* may be formed on the dielectric substrate.

(4) The shape and number of the patch radiating element 5 configuring the patch antenna 7 can also be appropriately determined. For example, a configuration may be possible in which a plurality of patch radiating elements 5 is arrayed in the x-axis direction for forming an array antenna.

Reference Signs List

1, 30, 50, 60, 70, 80 . . . Antenna device
2 . . . Dielectric substrate
3 . . . Ground plane
4, 31, 51, 61, 71, 81 . . . EBG
4*a*, 31*a*, 51*a*, 61*a*, 71*a*, 81*a* . . . Patch-shaped pattern
4*b*, 31*b*, 51*b*, 61*b*, 71*b*, 81*b* . . . Conducting via
5 . . . Patch radiating element
6 . . . Conductor plate
7 . . . Patch antenna
8 . . . EBG absent region

The invention claimed is:

1. An antenna device comprising:

a dielectric substrate having a ground plane formed on one of its plate faces;

a patch antenna having a dominant polarization direction in a predetermined direction, the patch antenna comprising:

a square shaped patch radiating element for supplying electric power provided on the patch antenna, the patch radiating element being formed on a plate face on an opposite side of the plate face of the dielectric substrate on which the ground plane is formed;

an electromagnetic band gap (EBG) absent region formed on the center part of the substrate front face and has a square shape, and the patch radiating element is disposed in the center of the EBG absent region and is surrounded by the EBG absent region; and a plurality of the conductive structures, each of the plurality of conductive structures comprising:

a patch-shaped conductor pattern formed on a substrate front face that is the plate face of the dielectric substrate on which the patch radiating element is formed;

a plurality of connection conductors formed across the conductor pattern and the ground plane to penetrate the dielectric substrate for electrically connecting the conductor pattern to the ground plane;

wherein the plurality of conductor structures are not disposed in the EBG absent region.

2. The antenna device according to claim 1, wherein the conductive structure has at least one group including a plurality of the connection conductors arrayed in a row; and an array direction of the plurality of connection conductors configuring the group is different from the dominant polarization direction of the patch antenna.

3. The antenna device according to claim 2, wherein an array direction of the plurality of connection conductors configuring the group is a direction perpendicular to the dominant polarization direction of the patch antenna.

4. The antenna device according to claim 1, wherein around the patch radiating element configuring the patch antenna on the substrate front face, a conductor pattern absent region is formed, the conductor pattern absent region including the patch radiating element without the conductor pattern; and the conductor pattern is formed on an outer side of the conductor pattern absent region on the substrate front face.

5. The antenna device according to claim 1, wherein the plurality of connection conductors comprises at least four connection conductors formed across the conductor pattern and the ground plane to penetrate the dielectric substrate for electrically connecting the conductor pattern to the ground plane.

6. The antenna device according to claim 5, wherein the at least four connection conductors are formed across the conductor pattern in a single row.

7. The antenna device according to claim 5, wherein the at least four connection conductors are formed across the conductor pattern in two rows.

8. The antenna device according to claim 1, wherein the plurality of conductor structures are disposed on opposing sides of the EBG absent region.

9. The antenna device according to claim 8, wherein the conductor pattern comprises a square shape.

10. The antenna device according to claim 8, wherein the conductor pattern comprises a hexagonal shape.

* * * * *